US005762517A

United States Patent [19]

Abe

[11] Patent Number: 5,762,517

[45] Date of Patent: Jun. 9, 1998

[54] PRESS-CONNECTING JOINT CONNECTOR

[75] Inventor: Kimihiro Abe, Shizuoka, Japan

[73] Assignee: Yazaki Corporation, Tokyo, Japan

[21] Appl. No.: 595,921

[22] Filed: Feb. 6, 1996

[30] Foreign Application Priority Data

Feb. 9, 1995 [JP] Japan ..... 7-021771

[51] Int. Cl.[6] ..... H01R 4/24

[52] U.S. Cl. ..... 439/402

[58] Field of Search ..... 439/402, 417, 439/403, 404, 405, 409, 395, 449, 418, 398; 29/866

[56] References Cited

U.S. PATENT DOCUMENTS

| | | | |
|---|---|---|---|
| 3,835,444 | 9/1974 | Plana et al. | 439/398 |
| 4,274,696 | 6/1981 | Long et al. | 439/395 |
| 4,778,405 | 10/1988 | Sterken | 439/395 |
| 5,147,217 | 9/1992 | Neale, III et al. | 439/403 |
| 5,330,367 | 7/1994 | Janczak | 439/402 |
| 5,371,323 | 12/1994 | Schneider et al. | 174/92 |
| 5,562,478 | 10/1996 | Yamamoto | 439/402 |

*Primary Examiner*—Gary F. Paumen
*Assistant Examiner*—Tho D. Ta
*Attorney, Agent, or Firm*—Sughrue, Mion, Zinn, Macpeak & Seas, PLLC

[57] ABSTRACT

A press-connecting joint connector in which press-connecting blades, formed on a terminal, can be flexed in a generally equal amount, and the pitch of wires is reduced to thereby achieve a small-size design of the connector. A plurality of press-connecting blades (11) and (12), formed on a terminal (9) held by a connector body (2), are arranged in a staggered manner. Inner end portions (13) and (14) of the press-connecting blades (11) and (12) are disposed in a common plane, and the inner end portions (13) and (14) are held by intermediate walls (8) formed integrally on the connector body. A thickness of the intermediate wall is substantially equal to a width of the inner end portions (13) and (14). The distance between a side wall (7) of the connector body and the intermediate wall (8) is substantially equal to an outer diameter of the sheathed wire. Outer end portions of the press-connecting blades are embedded in the opposite side walls of the connector body, respectively. With this construction, the width of the connector body is reduced, thereby achieving a small-size design of the press-connecting joint connector.

11 Claims, 6 Drawing Sheets

PRESS-CONNECTING JOINT CONNECTOR

BACKGROUND OF THE PRESENT INVENTION

1. Field of Industrial Utility

This invention relates to a press-connecting joint connector for electrically connecting a plurality of sheathed wires together, and more particularly to a press-connecting joint connector in which the pitch of the electric wires can be reduced.

2. Related art

There have heretofore been proposed various press-connecting joint connectors in which wires are press-connected within a connector body. One such a press-connecting joint connector is disclosed, for example, in Japanese Patent Unexamined Publication No. 58-214283.

FIG. 6 is an exploded, perspective view of such a conventional press-connecting joint connector. This press-connecting joint connector 51 comprises a terminal 56 consisting of a metal plate having a pair of right and left press-connecting blades 53 and 54 juxtaposed at a pitch P1 for electrically connecting two sheathed wires 5 together. The terminal also includes a relief groove 55 formed in a central portion thereof. The connector also comprises a strain reduction member 61 which includes an upstanding cutting plate 58 and a strain reduction portion 60 having a pair of end walls 59 disposed parallel to the cutting plate 58. The terminal 56 is held at its tabs 57 by the cutting plate 58, and the cutting plate 58 has a sharp cutting edge at its upper end. The connector further comprises a connector body 63 for holding the terminal 56 and the strain reduction member 61, an upwardly-openable lid 62 hingedly mounted on the connector body for movement between an open and a closed position, and a cover 66 which has retaining projections 64 and wire receiving grooves 65 at its lower side. The connector body 63 has retaining ribs 67 for respectively engaging the retaining projections 64 of the cover, and a holder groove 68 for holding the terminal 56.

In the above construction, the strain reduction member 61 is first fitted into the connector body 63, and then the terminal 56 is held in the holder groove 68. Thereafter, the wires 5 are received in the wire receiving grooves 65, and the cover 66 is press-fitted into the connector body from the upper side, so that the wires 5 are cut by the cutting plate 58, and the sheaths of the wires 5 are cut respectively by the press-connecting blades 53 and 54 of the terminal 56. As a result, conductors of the two wires electrically contact the press-connecting blades 53 and 54, respectively, so that the two wires are electrically connected together, and are held in the connector body 63 by the bottom surface of the cover 66. After the retaining projections 64 are retained by the retaining ribs 67, respectively, the lid 62 is pivotally moved to its closed position, and is retainingly held in this position by the connector body 63. Since the terminal 56 has the relief groove 55, the press-connecting blades 53 and 54 can be flexed equally.

FIG. 7 shows another conventional terminal of a pressing-connecting joint connector. The terminal 70 has two press-connecting blades 71 and 72, but does not have a relief groove between the press-connecting blades 71 and 72. Therefore, although the pitch P2 of the wires 5 is smaller, the press-connecting blades 71 and 72 are substantially flexed outwardly when the wires 5 are press-fitted into the blades 71 and 72, respectively.

In the above conventional press-connecting joint connector in which the relief groove 55 is provided between the press-connecting blades 53 and 54 in the terminal 56, the pitch P1 is increased by an amount corresponding to the width of the relief groove 55 so that the overall size of the connector is relatively large.

On the other hand, when no relief groove is provided between the press-connecting blades 71 and 72 in the terminal 70 in order to reduce the width of the connector, the press-connecting blades 71 and 72 are substantially flexed outwardly when the wires 5 are press-fitted into these blades, respectively, and this also invites a problem in that the two press-connecting blades 71 and 72 are not flexed in an equal amount.

This invention has been made in view of the above problems, and an object of the invention is to provide a press-connecting joint connector in which press-connecting blades on a terminal can be flexed in a generally equal amount, and the pitch of wires is reduced to thereby achieve a compact connector.

SUMMARY OF THE INVENTION

The above object has been achieved by a press-connecting joint connector of the invention comprising a terminal having a plurality of press-connecting blades electrically connected together so as to electrically connect a plurality of sheathed wires together, wherein the terminal is held on one of a connector body and a cover for covering the connector body while a wire-pressing portion for pressing the wires respectively into the press-connecting blades is formed on the other; characterized in that the plurality of press-connecting blades, formed on the terminal, are arranged in a staggered manner; one end portions of any two adjacent ones of the press-connecting blades are disposed in a common plane; the one end portions in the common plane are held by intermediate walls formed integrally on the one of the connector body and the cover; and a thickness of the intermediate wall is substantially equal to a width of the one end portions of the press-connecting terminals.

The above object can be achieved by a construction in which the distance between a side wall of the one of the connector body and the cover holding the terminal and the intermediate wall is substantially equal to an outer diameter of the sheathed wire.

The above object can be achieved by a construction in which the other end portions of opposite outermost ones of the press-connecting blades are embedded in the opposite side walls, respectively.

In the press-connecting joint connector of the above construction according to the present invention, when the plurality of sheathed wires are pressed respectively against the plurality of press-connecting blades (which are formed in a staggered manner on the terminal held on the connector body) by a tool or the wire-pressing portion formed on the cover, the sheath of each wire is cut, and its conductor is brought into contact with the associated press-connecting blade, so that the plurality of wires are electrically connected together. At this time, since the press-connecting blades are arranged in a staggered manner, they can be flexed equally without interference with each other. Additionally, since the one end portions of the adjacent press-connecting blades are disposed in a common plane, the terminal and the connector body can be reduced in width.

The one end portions of the press-connecting blades disposed in the common plane are held by the intermediate walls formed on the connector body, and the thickness of the intermediate wall is substantially equal to the width of the one end portions of the press-connecting blades.

The distance between the intermediate wall and the side wall of the connector body or the cover is substantially equal to the outer diameter of the sheathed wire.

With this construction, when the plurality of wires are pressed respectively into the press-connecting blades at the same time, the sheath of each wire contacts the one end portion of the adjacent press-connecting blade, so that undue flexure of the press-connecting blade is prevented, and therefore there can be obtained the highly-reliable press-connecting joint connector.

The other end portions of opposite outermost ones of the press-connecting blades are embedded in the opposite side walls, respectively. With this construction, the width of the connector body is further reduced, thereby promoting the small-size design of the press-connecting joint connector.

DETAILED DESCRIPTION OF THE INVENTION

Figure 1:
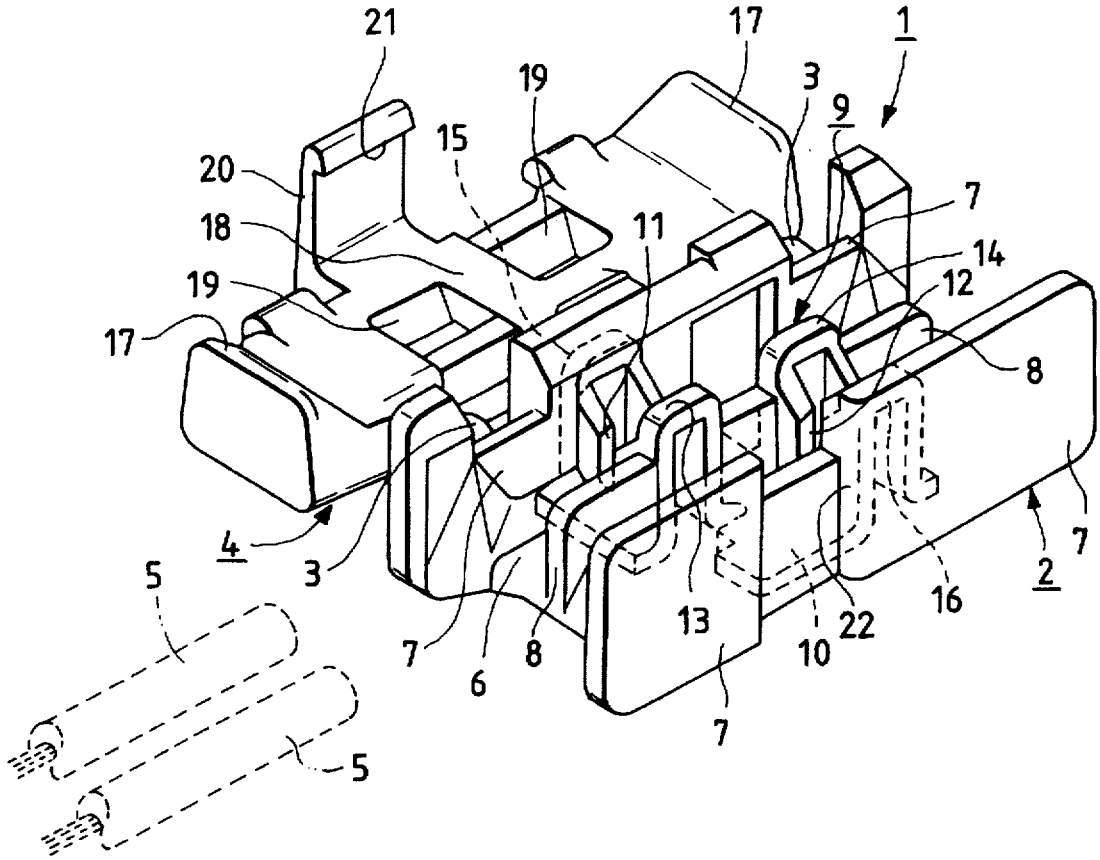
FIG. 1 is a perspective view of one preferred embodiment of a press-connecting joint connector of the present invention.
Figure 2:
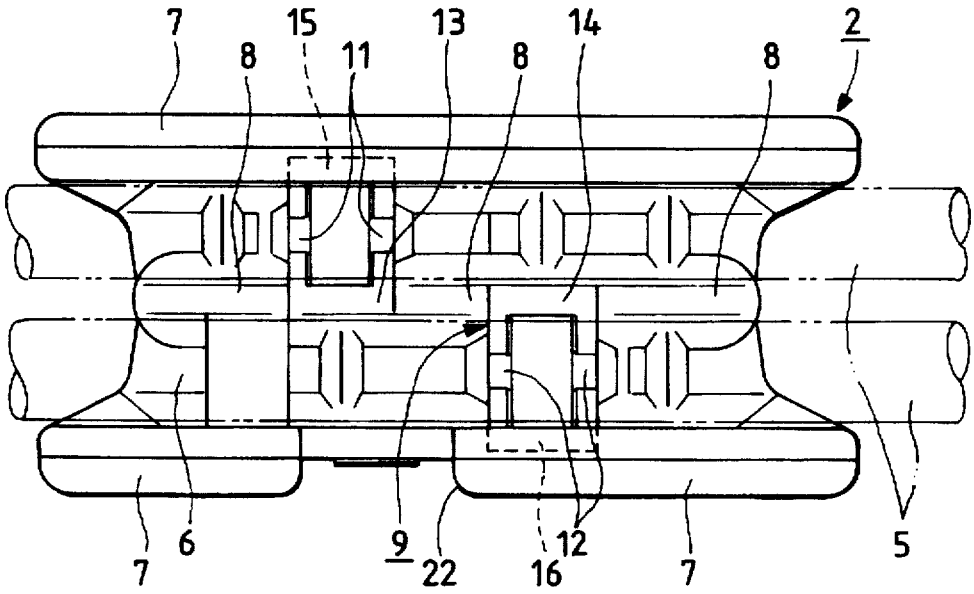
FIG. 2 is a plan view of a connector body of the connector of FIG. 1.
Figure 3:
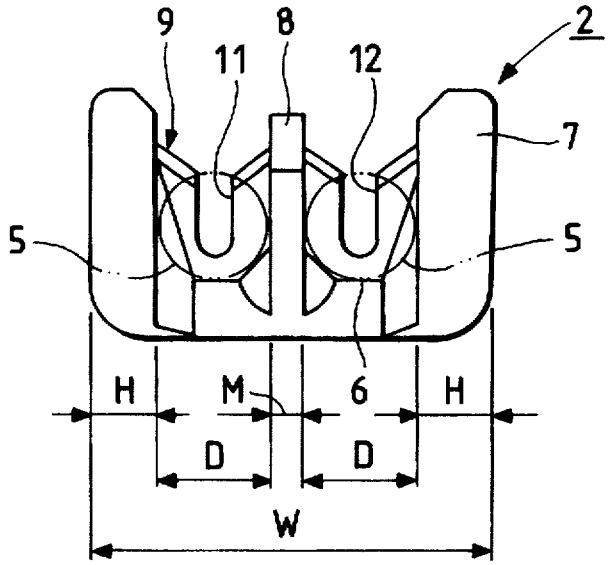
FIG. 3 is a side-elevational view of the connector body of FIG. 2.
Figure 4:
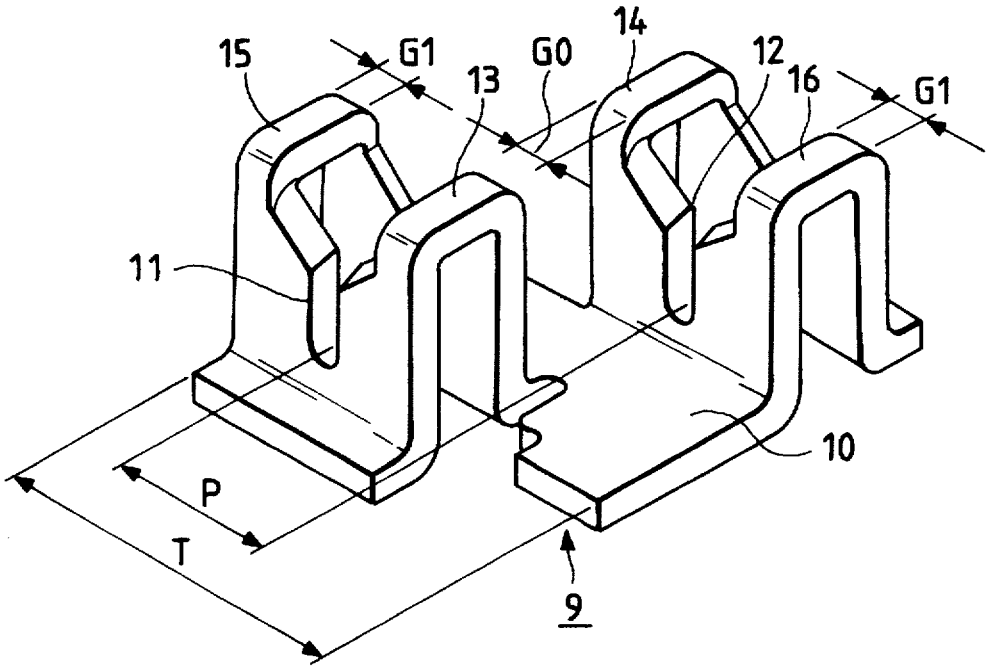
FIG. 4 is a perspective view of a terminal of the connector of FIG. 1.
Figure 5:
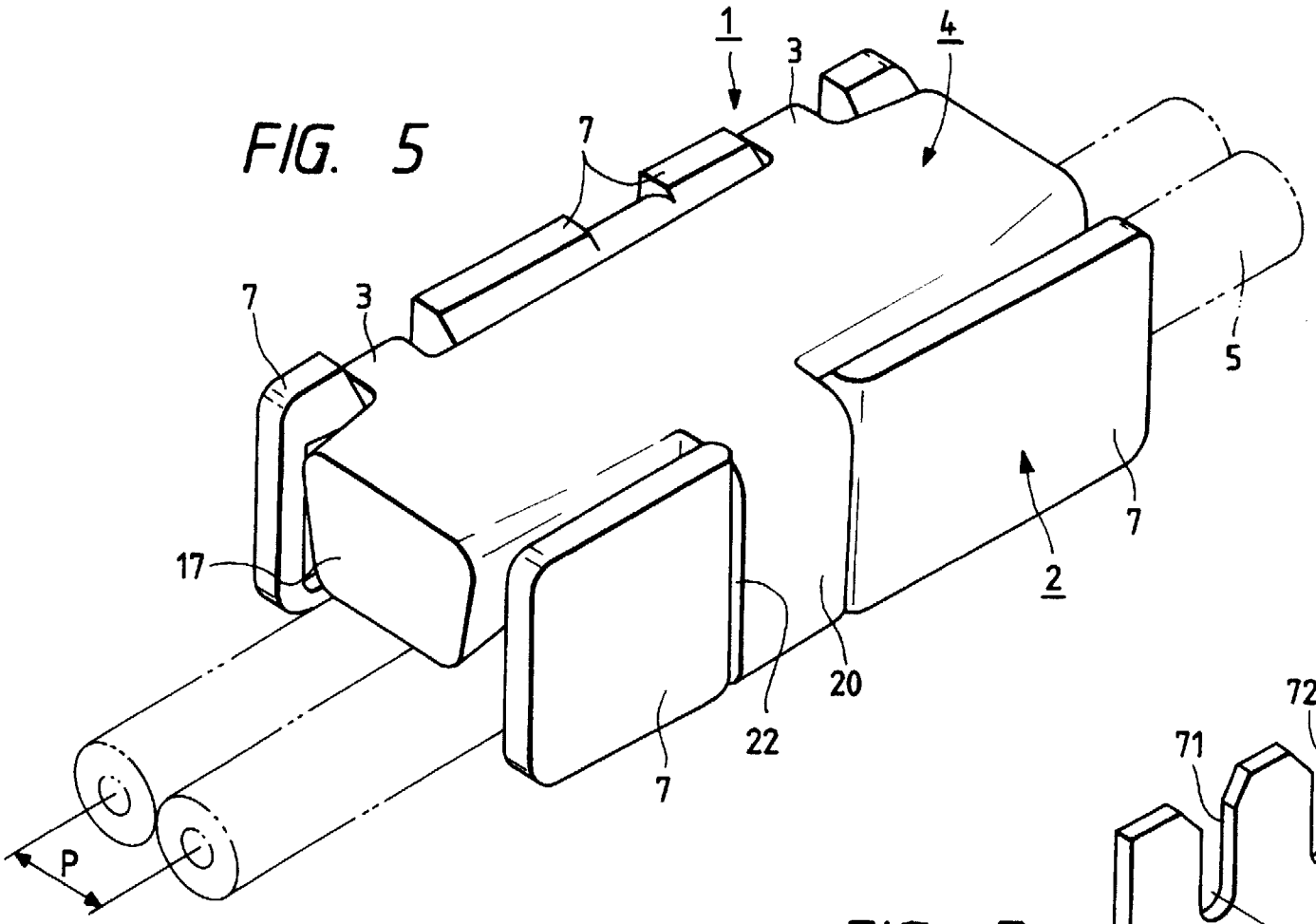
FIG. 5 is a perspective view of the connector of FIG. 1 in its assembled condition.
Figure 7:
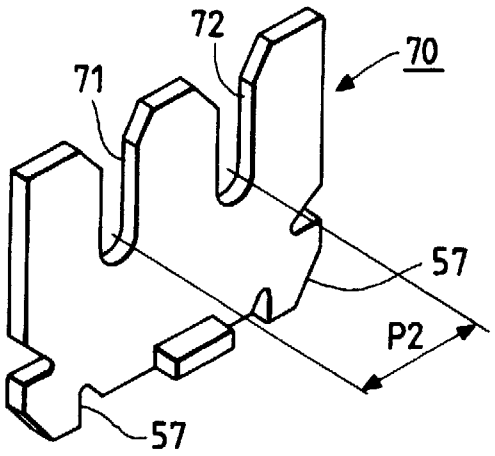
FIG. 7 is a perspective view of a conventional terminal.
Figure 6:
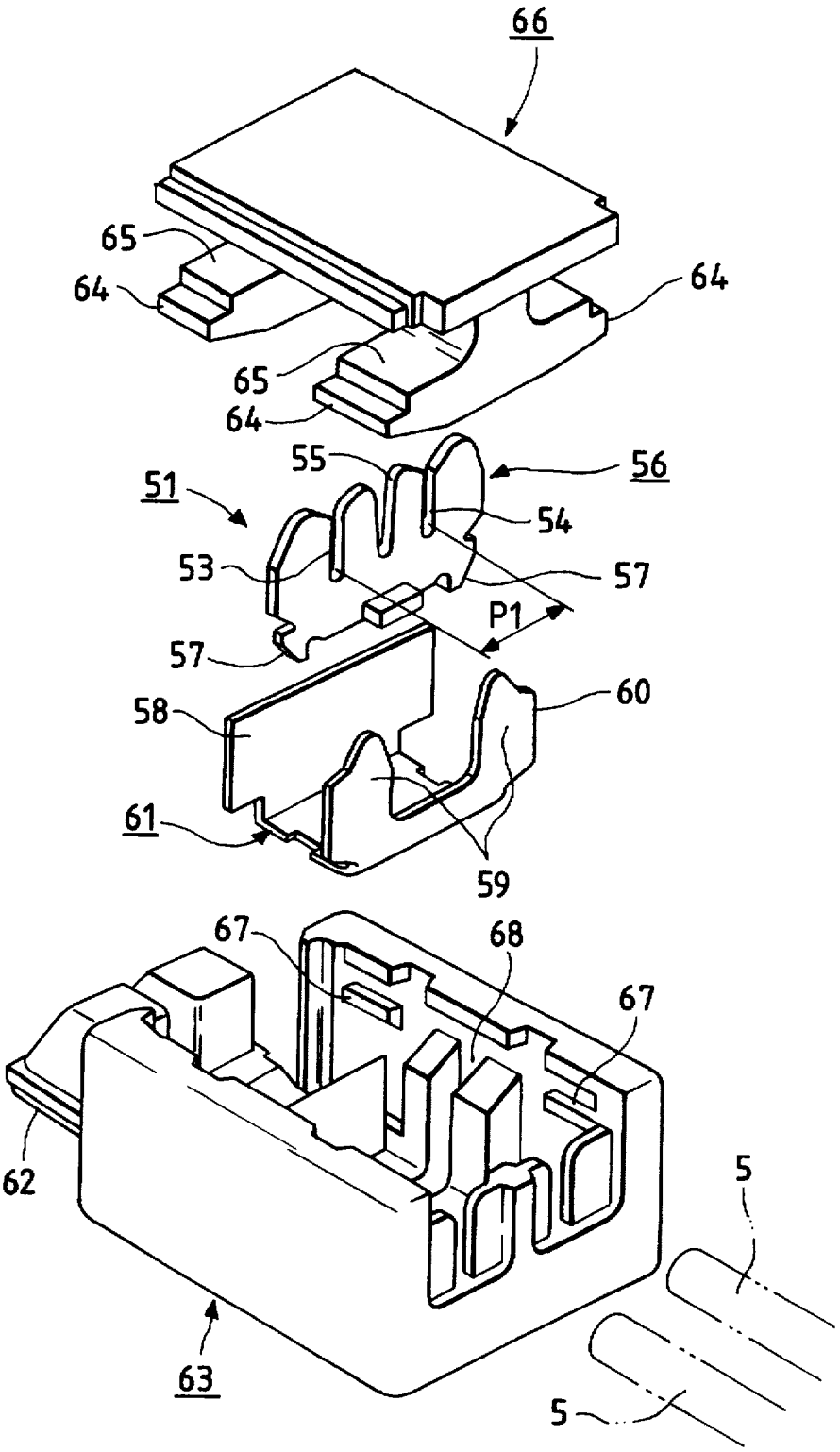
FIG. 6 is an exploded, perspective view of a conventional press-connecting joint connector.
Figure 8:
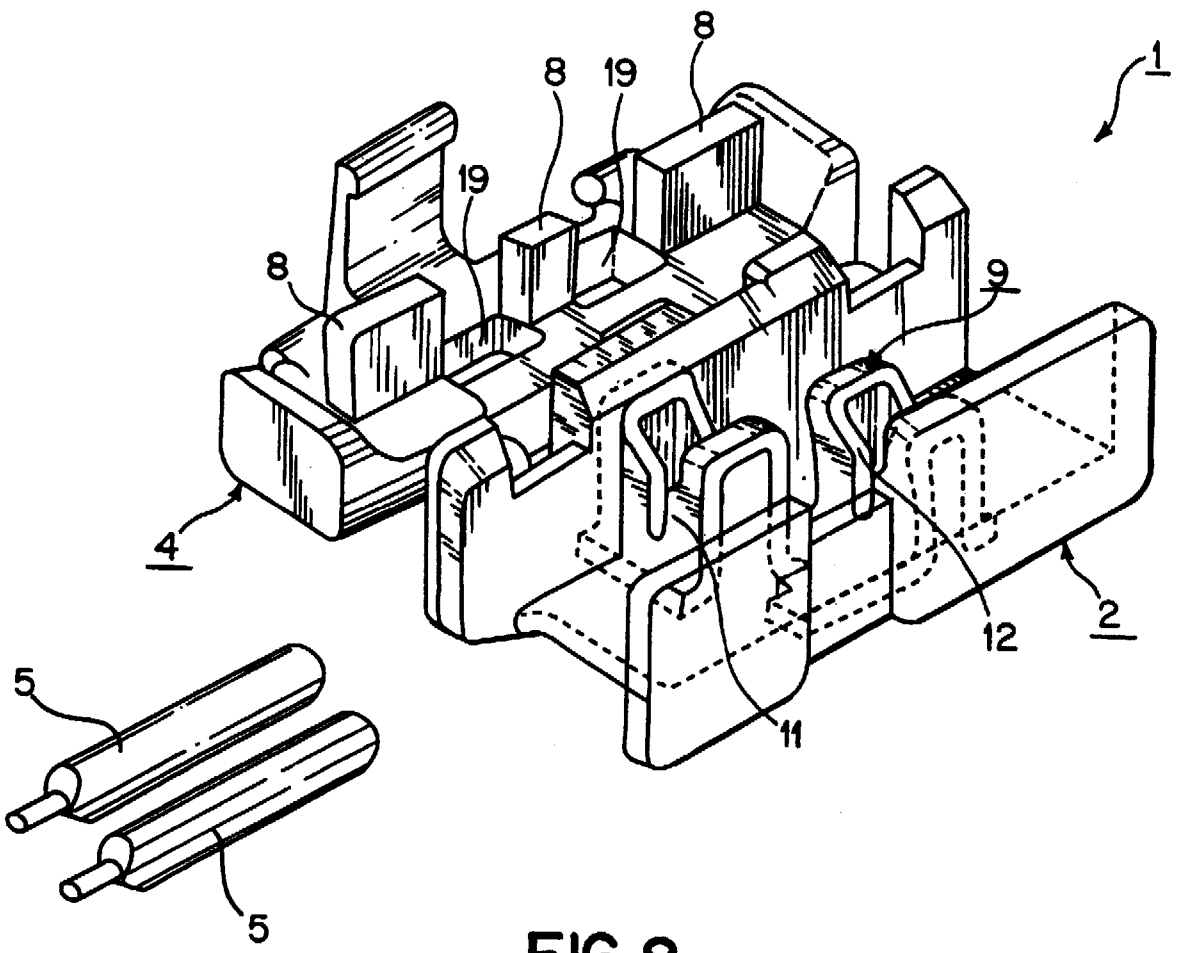
FIG. 8 is a perspective view of another embodiment of the present invention having he intermediate wall in the cover.
Figure 9:
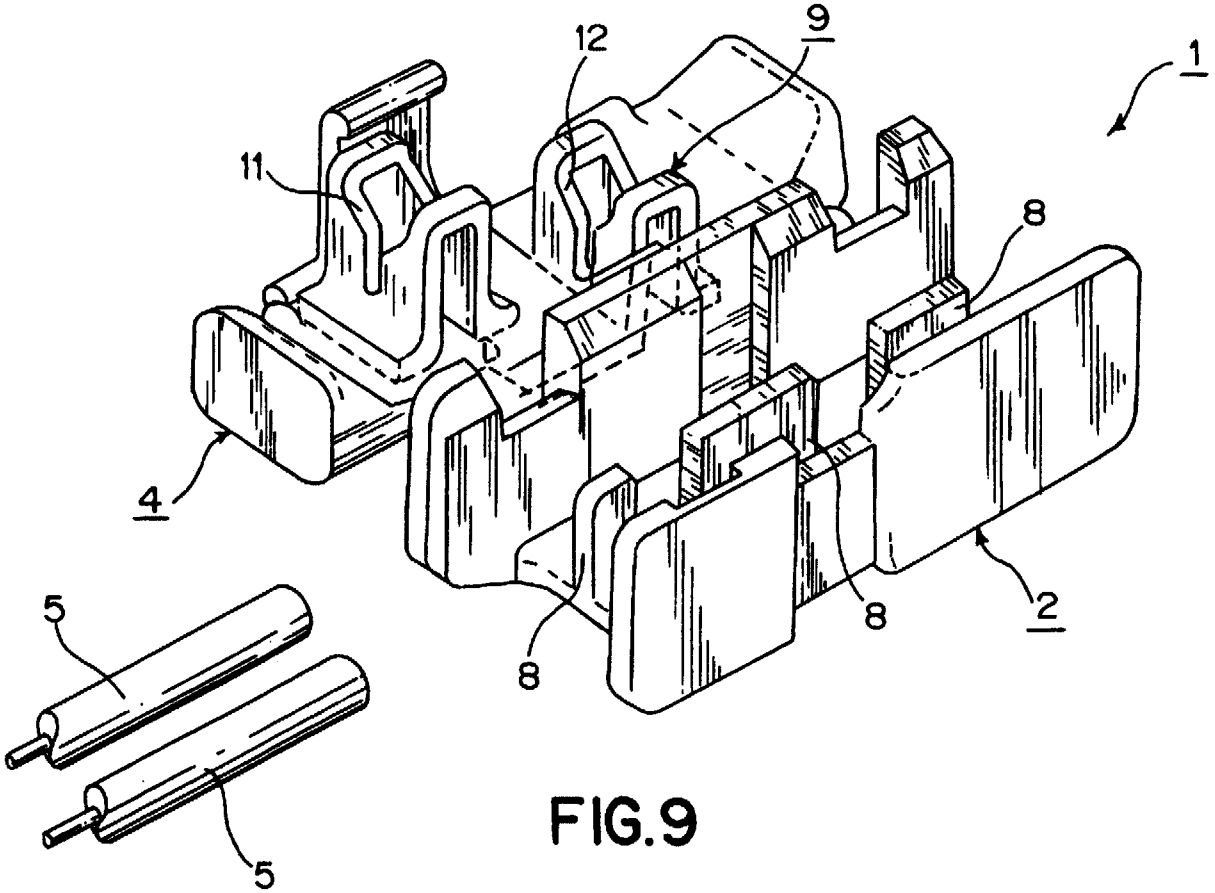
FIG. 9 is a perspective view of another embodiment of the present invention wherein the terminal is retained in the cover portion.

One preferred embodiment of a press-connecting joint connector of the present invention will now be described in detail with reference to FIGS. 1 to 5. FIG. 1 is a perspective view of one preferred embodiment of the press-connecting joint connector of the invention. FIG. 2 is a plan view of a connector body of the connector of FIG. 1, FIG. 3 is a side-elevational view of the connector body of FIG. 2, FIG. 4 is a perspective view of a terminal of the connector of FIG. 1, and FIG. 5 is a perspective view of the connector of FIG. 1 in its assembled condition. Although this embodiment is directed to a press-connecting joint connector for electrically connecting two sheathed wires 5 together, the invention is not to be limited to such a construction.

As shown in FIG. 1, the press-connecting joint connector 1 comprises a connector body 2 molded of a synthetic resin, and a cover 4 pivotally connected by hinges 3 to the connector body 2. As shown in FIGS. 2 and 3, the connector body 2 includes side walls 7 integrally formed with respect to bottom wall 6 and extending upwardly therefrom, as well as intermediate walls 8 that extend parallel to the side walls and are located centrally between the side walls. The terminal 9 is provided in spaces formed by the bottom wall 6, the side walls 7 and the intermediate walls 8. The terminal 9 is molded to the connector body 2 when the connector body 2 is molded, or is fitted into the molded connector body 2.

As shown in detail in FIG. 4, the terminal 9 has two press-connecting blades 11 and 12 extending upright from a bottom plate 10 with the two blades 11 and 12 being arranged in a staggered manner. An inner end portion 13 of one press-connecting blade 11 and an inner end portion 14 of the other press-connecting blade 12 are disposed in a common plane. Each of the end portions 13 and 14 is held between the intermediate walls 8, and the thickness M (see FIG. 3) of the intermediate wall 8 is equal to the width G0 of the end portions 13 and 14.

As shown in FIGS. 1 and 4, an outer end portion 15 of the press-connecting blade 11 and an outer end portion 16 of the press-connecting blade 12 have a width G1 which allows them to be embedded in the opposite side walls 7 of the connector body 2, respectively. Further, the distance D (see FIG. 3) between the intermediate wall 8 of the connector body 2 and the side walls 7 is equal to the outer diameter of the sheathed wire 5.

As shown in FIG. 1, the cover 4 has wire-pressing portions 17 formed respectively at opposite longitudinal ends thereof in a projected manner, and a reverse, or bottom, surface 18 of the cover 4 functions to press the wires 5 into the grooves defined by the press-connecting blades 11 and 12. Openings 19 in the bottom surface 18 receive the inner end portions 13, 14. The cover 4 has a lock arm 20 which includes a retaining projection 21 at its distal end so that the cover 4 can be lockingly engaged with the bottom wall 6 by the retaining projection 21. An opening 22 for receiving the lock arm 20 is formed in the side wall 7 which is opposite to the side wall to which the hinged portion of the cover 4 is attached.

In this embodiment of the above construction, the two wires 5 are first pressed respectively into the press-connecting blades 11 and 12 from the upper side of the connector body 2 either by a tool or by the reverse surface 18 and the wire-pressing portions 17 of the cover 4. As a result, the sheath of each wire 5 is cut, and the conductor of each wire 5 is brought into contact with the associated press-connecting blade 11, 12, so that the two wires 5 are electrically interconnected.

Thereafter, the cover 4 is retainingly engaged with the bottom wall 6 through the retaining projection 21 of the lock arm 20, thus completing the assembly of the press-connecting joint connector 1, as shown in FIG. 5.

In the above operation, since the plurality of press-connecting blades 11 and 12 are arranged in a staggered manner, they can be flexed equally without interference with each other. Therefore, the life of the connector is prolonged, and the reliability is enhanced. Further, since the inner end portions 13 and 14 of the adjacent press-connecting blades 11 and 12 are disposed in a common plane in juxtaposed relation to each other, the width T (see FIG. 4) of the terminal 9, as well as the associated pitch P of the wires (see FIGS. 4 and 5), are reduced. Correspondingly, the overall width W of the connector body 2 is reduced, thereby achieving a compact connector 1.

The inner end portions 13 and 14 of the press-connecting blades 11 and 12 disposed in the common plane are held by the intermediate walls 8, and the thickness M of the intermediate wall 8 is equal to the width GO (see FIG. 4) of the inner end portions 13 and 14 of the press-connecting blades 11 and 12. Additionally, the distance D between the intermediate wall 8 of the connector body 2 and the side wall 7 is equal to the outer diameter of the sheathed wire 5. Therefore, when the two wires 5 are pressed respectively against the two press-connecting blades 11 and 12 at the same time, the sheath of each wire 5 contacts the inner end portion 13, 14 of the adjacent press-connecting blade 11, 12. Therefore, the flexure of the press-connecting blade 11, 12 is prevented by the connector body 2, the intermediate wall 8, the side walls 7 and the wire 5, thereby enhancing the reliability of the press-connecting joint connector 1.

Furthermore, since the outer end portions 15 and 16 of the press-connecting blades 11 and 12 are embedded respectively in the side walls 7 of the connector body 2, the width W (see FIG. 3) of the connector body 2 is reduced, and therefore the compact design of the press-connecting joint connector 1 is further promoted.

The present invention is not to be restricted to the above embodiment, and modifications can be made. For example, although the terminal 9 has the two press-connecting blades 11 and 12 in the above embodiment, more than two press-connecting blades can be provided at the terminal 9 in a staggered manner, in which case the number of intermediate walls 8 increases with the increase in the number of the press-connecting blades.

Additionally, although the intermediate walls 8 are formed on the connector body 2 in the above embodiment, they may be formed on the reverse surface 18 of the cover 4.

As described above, in the press-connecting joint connector of the present invention, the plurality of press-connecting blades are arranged in a staggered manner, and one end portions of the adjacent press-connecting blades are disposed in a common plane in juxtaposed relation to each other, so that the compact design of the press-connecting joint connector can be achieved. Since the distance between the side wall of the connector body or the cover and the intermediate wall is equal to the outer diameter of the wire, the flexure of each press-connecting blade is prevented by the intermediate wall, the side walls and the wire, thereby enhancing the reliability of the press-connecting joint connector.

Since one end portion of each of the plurality of press-connecting blades is embedded in a side wall of the connector body, the width of the connector body can be further reduced, and this further promotes the compact design of the press-connecting joint connector.

We claim:

1. A press-connecting joint connector, comprising:

a connector housing including a base portion and a cover portion;

a pair of opposing side walls extending in a longitudinal direction;

a terminal disposed in said connector housing and including a plurality of interconnected press-connecting blades having slots for respectively receiving wires extending in said longitudinal direction of said connector housing so as to electrically interconnect said wires, wherein the most immediate adjacent ones of said press-connecting blades are offset from each other in said longitudinal direction and offset from each other in a transverse direction of said connection housing such that inner end portions of said adjacent ones of said press-connecting blades are disposed in a common plane so as to at least partially overlap one another, and outer end portions of said press-connecting blades are received in said opposing side walls, respectively.

2. The joint connector of claim 1, wherein said terminal is retained in said cover portion.

3. The joint connector of claim 1, wherein said terminal is retained in said base portion.

4. The joint connector of claim 3, wherein said cover portion includes wire pressing members for pressing said wires into said slots, respectively.

5. The joint connector of claim 3, wherein said base portion includes an intermediate wall located between side walls and extending parallel thereto.

6. The joint connector of claim 5, wherein the distance between an inner surface of one of said side walls and an opposing surface of said intermediate wall is substantially equal to the outer diameter of the sheath of a wire received in a space defined thereby.

7. The joint connector of claim 5, wherein said outer end portions are embedded in said opposing side walls, respectively.

8. The joint connector of claim 5, wherein said intermediate wall has openings therein in which said inner end portions of said press-connecting blades are respectively received.

9. The joint connector of claim 8, wherein the width of said intermediate wall is substantially the same as the width of said inner end portions.

10. The joint connector of claim 1, wherein said cover portion includes an intermediate wall having openings in which said inner end portions are received.

11. The joint connector of claim 10, wherein the thickness of said intermediate wall is substantially the same as the thickness of said inner end portions.

* * * * *